United States Patent [19]

Götzenberger

[11] Patent Number: 4,606,199

[45] Date of Patent: Aug. 19, 1986

[54] EXPANSION VALVE

[75] Inventor: Rudibert Götzenberger, Remseck, Fed. Rep. of Germany

[73] Assignee: Ernst Flitsch GmbH & Co., Fellbach, Fed. Rep. of Germany

[21] Appl. No.: 678,643

[22] Filed: Dec. 6, 1984

[30] Foreign Application Priority Data

Dec. 12, 1983 [DE] Fed. Rep. of Germany ..... 3344816

[51] Int. Cl.[4] ..... F25B 41/04

[52] U.S. Cl. ..... 62/225; 251/30.01

[58] Field of Search ..... 62/222, 223, 224, 225, 62/204, 205, 206, 210, 211, 212; 236/84, 80 F; 251/30, 38, 43, 45, 46

[56] References Cited

U.S. PATENT DOCUMENTS

| | | | |
|---|---|---|---|
| 2,305,151 | 12/1942 | Fields | 251/30 X |
| 3,079,952 | 3/1963 | Miller | 251/30 X |
| 4,235,414 | 11/1980 | Lis | 251/46 X |
| 4,270,726 | 6/1981 | Hertfelder et al. | 251/38 X |
| 4,310,142 | 1/1982 | Ludwig | 251/45 X |
| 4,448,038 | 5/1984 | Barbier | 62/225 X |

*Primary Examiner*—Harry Tanner

*Attorney, Agent, or Firm*—Erwin S. Teltscher

[57] ABSTRACT

The expansion valve has a valve lifter which has an axial capillary bore, a shoulder which abuts the membrane and a tapered end which passes through the membrane with clearance forming a gap. A plunger whose movement is controlled by a magnetic coil is used to close and open the capillary bore.

9 Claims, 2 Drawing Figures

EXPANSION VALVE

FIELD OF THE INVENTION

The present invention relates to expansion valves and, more particularly, to such valves when used in refrigeration equipment consisting of a compressor, a condensor and an evaporator.

BACKGROUND OF THE INVENTION

Thermostatic expansion valves are often used for metering liquid refrigerants injected into an evaporator. The expansion valves are controlled by a temperature sensor containing a vapor forming liquid, the temperature sensor being mounted at the discharge of the evaporator. The control is such that the vapor pressure of the liquid contained in the temperature sensor acts on the head of the expansion valve, the desired superheating at the outlet of the evaporator being set by means of a superheating spring.

These thermostatic expansion valves have a number of drawbacks. Since the valves must be matched to the refrigerant being used, the manufacturer is forced to supply a corresponding plurality of functionally equivalent units, or, alternatively, units with exchangeable jets or nozzles of different sizes. Furthermore, the time constant of such valves, which depends on the size of the diameter of the membrane or corrugated tubing, the spring temper of the superheating spring, the selected size of the jet and the refrigerant, can not be changed once the valve has been manufactured.

SUMMARY OF THE INVENTION

It is an object of the present invention to supply expansion valves which do not have the above-described drawbacks. Specifically, the need for a capillary tube connecting the temperature sensor to the head of the valve is to be obviated, and remote monitoring of the cooling cycle during operation is to be made possible.

The expansion valve according to the present invention operates in the refrigerating system, which has an evaporator having a discharge end or outlet, and a thermo-electric sensor located at the discharge end for furnishing a temperature dependent control signal. The expansion valve has a membrane which has a hole having a predetermined diameter. It further has a valve lifter which has an axial capillary bore and a shoulder which abuts the membrane. The end of the lifter which is near the valve seat has a larger diameter than the second end which is away from the valve seat. The diameter of the second end is less than the diameter of the first end and, furthermore, is less than the hole in the membrane through which it passes. The control signal changes the current in a coil which controls the movement of a plunger, the plunger in turn opening and closing the capillary bore in the valve lifter.

The expansion valve, according to the present invention, may be used to control a wide range of cooling powers from the smallest to the largest, independent of the refrigerant used. Gas filled parts which are subject to leakage are eliminated, and the operating life of the unit is increased by exchangeability of electrical parts.

The novel features which are considered as characteristic of the invention are set forth in particular in the appended claims. The invention itself, however, both as to its construction and its method of operation, together with additional objects and advantages thereof, will best be understood from the following description of specific embodiments, when read in connection with the accompanying drawing.

DESCRIPTION OF THE PREFERRED EMBODIMENT

Figure 1:
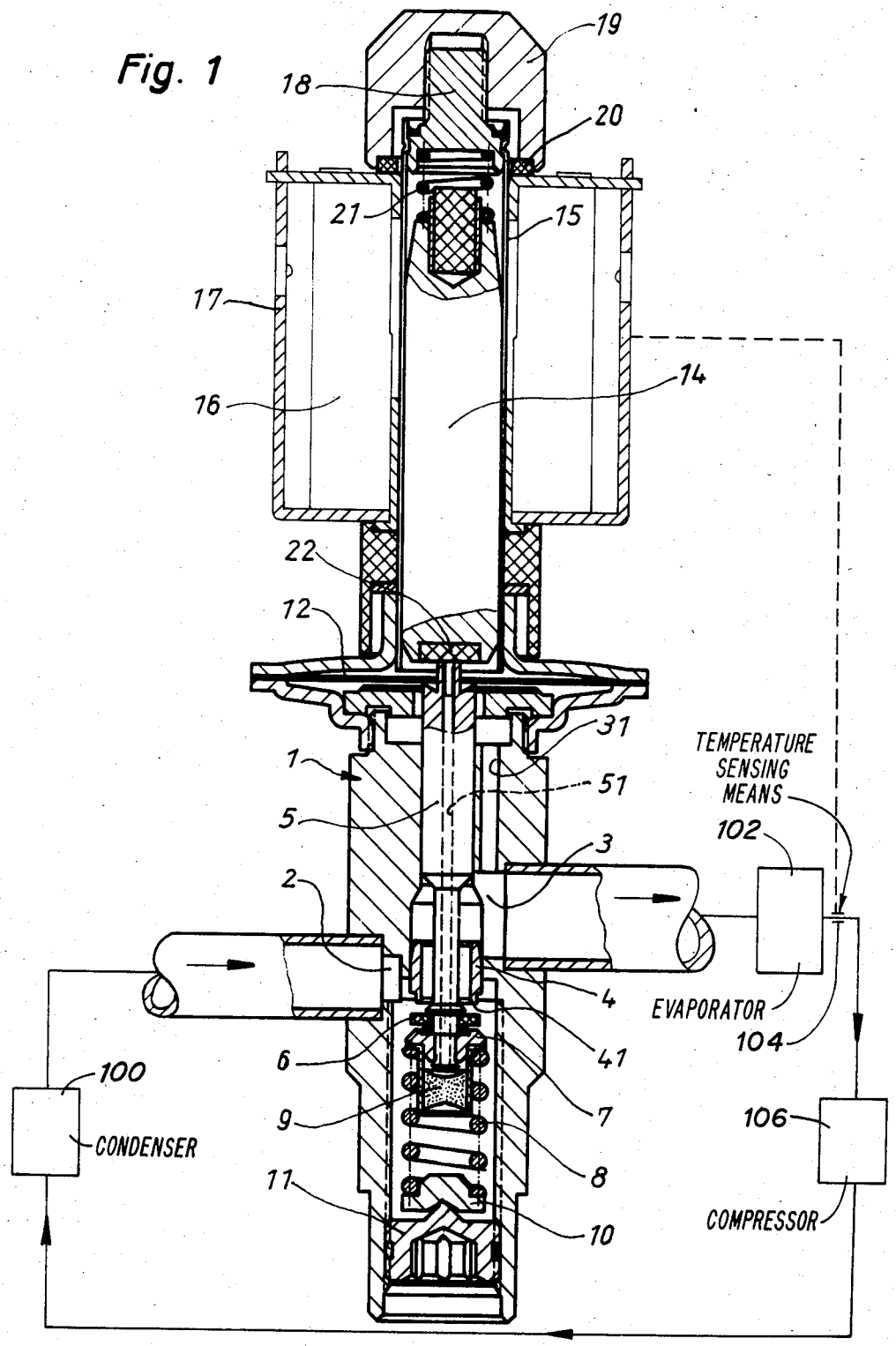
FIG. 1 is a longitudinal section through the valves.

The casing 1 of the valve has a refrigerant inlet 2 to which a suction line from a condensor 100 is connected and a discharge or outlet 3 connected to an evaporator 102. Temperature sensing means 104 are placed near the evaporator 102, and a conventional compressor 106 is disposed downstream of the evaporator 102 and the temperature sensing means 104. A valve lifter 5 passes through a bushing 4 which forms the valve seat 41 an end region of the valve lifter 5 coating with the valve seat 41. For closing the valve, valve seat 41 cooperates with a plastic ring target 6 which surrounds lifter 5 and rests against a shoulder of lifter 4 on one side and against an O ring within a recess of an annulus 7 on the other side. Annulus 7 has a shoulder which abuts a flange of a casing holding a filter 9. A helical spring 8 abuts an annular flange of the casing of the filter 9. Spring 8 is supported by a ring 10, which can be moved in the longitudinal direction of valve casing 1 by a hollow screw 11. Screw 11 engages a winding cut into casing 1.

Figure 2:
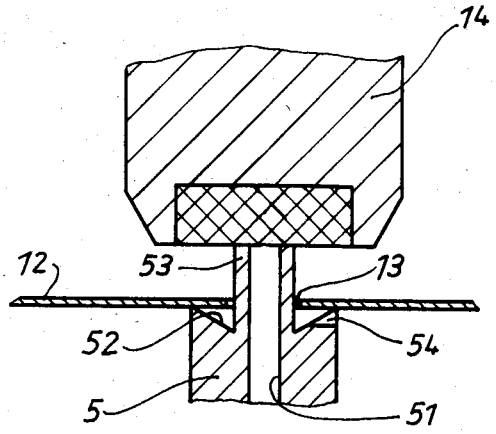
FIG. 2 is an enlarged portion of FIG. 1.

A capillary bore 51 passes through valve lifter 5. Near its upper end, lifter 5 has an annular shoulder 52 which abuts membrane 12 (FIG. 2). The uppermost portion, 53 of valve lifter 5 is peg-shaped, has a decreased diameter, and passes through an axial hole in membrane 12. The front face of plunger 14, movable in the longitudinal direction of the valve, faces a pin-shaped end portion 53 of valve lifter 5. The face of shoulder 52 of lifter 5 has an indentation from which shallow channels 54 emanate which pass through the casing and terminate in a channel 31 which in turn is connected to outlet 3. End 53 and membrane 12 are separated by an annular gap 13, so that when plunger 14 is lifted by increasing current through coil 16 caused by decreasing of the temperature responsive resistance of the sensor operating in the circuit of the coil 16, refrigerant which has been injected into the space above the membrane and has evaporated therein passes through annulus 13 into the suction pipe leading to the evaporator. During this time, the pressure exerted by the evaporated refrigerant on top of the membrane exceeds the evaporator pressure exerted on the underside. A sealing disk 22 of resilient material is affixed to the lower face of plunger 14 in order to effect a tight seal. Plunger 14 slides in a sleeve 15 made of a nonmagnetic material, so that the lines of force of a magnetic coil surrounding sleeve 15 can enter the plunger. The top end of the plunger is tapered, so that the length of stroke of the plunger is proportional to any applied voltage. A retaining spring 21 abuts the upper end of the plunger and is held in place by a screw bolt 18 rigidly connected to casing 15. A castle nut 19 is screwed onto bolt 18. A sealing ring 20 is arranged between the ring shaped face of castle nut 19 and the upper stop plate of housing 17. Magnetic coil 16 is arranged within housing 17. This arrangement allows the expansion valve to be mounted in any position and, for example, allows it to be incorporated into a moving vehicle wherein it may be subjected to centrifugal forces. To obviate any possibility of an interruption in refrigerant flow resulting in oscillations of valve lifter 5 in the region of valve seat 41 and disk 6, which closes the valve and forms a flat seat, the embodiment of FIG. 1 can be changed in such a way that the direction of refrigerant flow is reversed, i.e. that the refrigerant flows from region 3 through a radial bore within lifter 5 directly into the capillary bore 51 of lifter 5. In this embodiment the capillary bore 51 is closed at the lower end of lifter 5 and filter 9 can be dispensed with. A sieve can be inserted into capillary bore 51 to replace filter 9.

While the invention has been illustrated in a preferred embodiment, it is not to be limited to the specific members and structures shown, since many variations thereof will be evident to one skilled in the art and are intended to be encompassed in the present invention as set forth in the following claims.

I claim:

1. In a refrigeration control system including a compressor, a condenser, and an evaporator operatively connected to one another, and wherein a suction line connects said condenser to said evaporator, said evaporator having an outlet, and temperature sensing means located near said evaporator outlet for furnishing a control signal varying in dependence on the temperature prevailing at said evaporator outlet, and an electrically operated expansion valve located near an inlet of said evaporator for injecting a refrigerant into said evaporator, the improvement comprising expansion valve seating means disposed in said suction line, a membrane formed with a hole, said hole having a predetermined hole diameter, valve lifter means mounted for movement in a predetermined direction having a shoulder abutting said membrane, an end region coacting with said expansion valve seating means, a pin-shaped end portion opposite said end region, facing away from said expansion valve seating means, having a prearranged diameter less than said predetermined diameter of said membrane hole, so that an annular passage is formed between said pin-shaped end portion and a boundary defining said membrane hole, said pin-shaped end portion passing through said membrane hole, and being formed with a central axial capillary bore extending along said predetermined direction, and plunger means responsive to said control signal for opening and closing said capillary bore of said pin-shaped end portion in accordance with said control signal, whereby a wide range of cooling powers is controllable by said expansion valve.

2. An expansion valve as set forth in claim 1, wherein a gap is formed between said membrane and said lifter means;

wherein said shoulder of said lifter means defines a first chamber underneath said membrane, and said expansion valve has a second chamber above said membrane, an outlet, a refrigerant channel terminating at said outlet, and a plurality of through openings in said lifter means, said through openings connecting said first chamber to said refrigerant channel and therethrough to said outlet.

3. An expansion valve as set forth in claim 1, wherein said plunger means includes a plunger formed with a conical taper at an end thereof facing away from said membrane.

4. An expansion valve as set forth in claim 1, wherein said plunger means includes a plunger, and further comprising a magnetic coil receiving said control signal, a housing surrounding said magnetic coil, and a first spring mounted within said housing, said first spring acting on said plunger, whereby said expansion valve is operable even when subjected to centrifugal forces.

5. An expansion valve as set forth in claim 1, further comprising a valve casing enclosing said valve lifter means and a second spring arranged in said valve casing urging said valve lifter means towards said plunger means.

6. An expansion valve as set forth in claim 5, further comprising a bushing surrounding said valve lifter means and having a face forming said value seating means.

7. An expansion valve as set forth in claim 6, wherein said end region is ring shaped said expansion valve further comprising a plastic ring target cooperating with said ring shaped end region to close said valve.

8. An expansion valve as set forth in claim 1, further comrising filter means arranged before said capillary bore in the direction of the flow of said refrigerant.

9. An expansion valve as set forth in claim 1, wherein said plunger has a face opposite said pin-shaped end portion of said valve lifter means; and further comprising a sealing disk of resilient material affixed to said face of said plunger.

* * * * *